US008833285B1

(12) United States Patent
Czipri

(10) Patent No.: US 8,833,285 B1
(45) Date of Patent: Sep. 16, 2014

(54) BOAT CLEAT

(71) Applicant: R & D Shed, L.L.C., Clearwater, FL (US)

(72) Inventor: John Czipri, Boone, NC (US)

(73) Assignee: R & D Shed, L.L.C., Clearwater, FL (US)

( * ) Notice: Subject to any disclaimer, the term of this patent is extended or adjusted under 35 U.S.C. 154(b) by 0 days.

(21) Appl. No.: 14/068,326

(22) Filed: Oct. 31, 2013

(51) Int. Cl.
*B63B 21/04* (2006.01)

(52) U.S. Cl.
CPC ..... *B63B 21/04* (2013.01)
USPC ..... 114/218; 410/107

(58) Field of Classification Search
USPC ..... 114/218; 410/107, 111
See application file for complete search history.

(56) References Cited

U.S. PATENT DOCUMENTS 4,672,909 A 6/1987 Sweetsir
4,809,634 A 3/1989 Czipri
4,890,566 A 1/1990 Morris
4,945,849 A 8/1990 Morris et al.
5,004,388 A 4/1991 Harris
5,106,248 A 4/1992 Harris
5,301,627 A 4/1994 Czipri
5,535,694 A 7/1996 Czipri
5,983,820 A 11/1999 Whitley
6,125,779 A 10/2000 Czipri
8,393,285 B2 * 3/2013 Cleveland et al. ..... 114/218
8,402,907 B2 * 3/2013 Cleveland et al. ..... 114/218

* cited by examiner

*Primary Examiner* — Lars A Olson
(74) *Attorney, Agent, or Firm* — Larson & Larson, P.A.; Frank Liebenow; Justin P. Miller

(57) ABSTRACT

A cleat which has an extended operative position and a retracted position includes a securing portion and a base portion in the form of a housing which can receive the securing portion. The securing portion is shaped for securing thereto a line when the securing portion is in an extended position. When the securing portion is in a retracted position, the securing portion lay relatively flush with a surface of the boat. Detents are provided to hold the securing portion in the extended position until pressure is exerted on the securing portion to overcome the detents and transition the securing portion from the extended position to the retracted position.

18 Claims, 4 Drawing Sheets

BOAT CLEAT

FIELD

This invention relates generally to boat cleats having a depressed retracted position and which are capable of being raised to an extended, operative position.

BACKGROUND

Cleats having a depressed inoperative position which can be moved to an operative position are well known in the art; such as seen in U.S. Pat. Nos. 5,535,694; 5,301,627, 4,809,634. Such cleats lay substantially flush against the boat deck when retracted and extend outwardly from the boat deck when they are extended, permitting a line to be properly secured as with a stationary boat cleat.

In the prior boat cleats, two threaded posts are provided for securing the boat cleat to the boat deck. During the molding/fabrication process, the threads are typically formed on the posts and two sets of nuts and lock washers must be provided to secure the boat cleat to the boat deck, substantially increasing the cost of the boat cleat and increasing the complexity of manufacturing and installation. Often, for aftermarket installation, the underside of the boat deck/hull is difficult to access, making installation of two nuts and lock washers difficult. Since the prior boat cleats have two such posts and two receiving members, four holes must be drilled in the boat deck, properly sized and spaced, adding to the effort of installing the boat cleats of the prior art.

Furthermore, because the securing portions of the boat cleat must move freely in/out of receiving members, there is a potential for water to penetrate the small gap between these features and make its way to the hull of the boat.

What is needed is a boat cleat that will easily move from a retracted position to an extended position and back, having improved water resistance and simplified manufacture and installation.

SUMMARY

A cleat which has an extended operative position and a retracted position includes a securing portion and a base portion in the form of a housing which can receive the securing portion. The securing portion is shaped for securing thereto a line when the securing portion is in an extended position. When the securing portion is in a retracted position, the securing portion lay relatively flush with a surface of the boat. Detents are provided to hold the securing portion in the extended position until pressure is exerted on the securing portion to overcome the detents and transition the securing portion from the extended position to the retracted position.

In one embodiment, a cleat assembly is disclosed including a securing member for accepting a line and a base member. The securing member has a surface and two legs depending from an underside of the surface. The legs are spaced apart. The base member has two receiving members spaced to align with the legs, such that, the legs extend into bores of the receiving members. The base member includes a single threaded bolt portion depending from the base member between the receiving members. A mechanism (e.g., bolts and optional washers) slideably retains the legs within the bores of the receiving members.

In another embodiment, a method of installing a boat cleat is disclosed including providing the boat cleat described above and creating exactly three holes in a surface (e.g., a surface of a boat, dock, etc.). Each hole aligns with one of the legs or the single threaded bolt portion. The legs and the single threaded bolt portion are inserted through the holes and a nut (and optional lock washer) is threaded onto the single threaded bolt portion and tightened, thereby securing the boat cleat to the surface.

In another embodiment, a cleat assembly is disclosed including a securing member for accepting a line and a base member. The securing member has a surface with two spaced apart legs depending from the surface. The base member has two receiving members spaced to align with the legs such that the legs extend into bores of the receiving members. The base member further comprises a single threaded bolt portion depending from the base member between the receiving members for securing to a surface such as a boat deck. A detent mechanism is formed between the legs and the bores such that, when the securing mechanism is in an extended position, the detent mechanism holds the securing mechanism in the extended position until an overcoming force is applied on the securing mechanism in a direction of the base member. The legs are slideably held within the bores of the receiving members by corresponding fasteners and washers.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
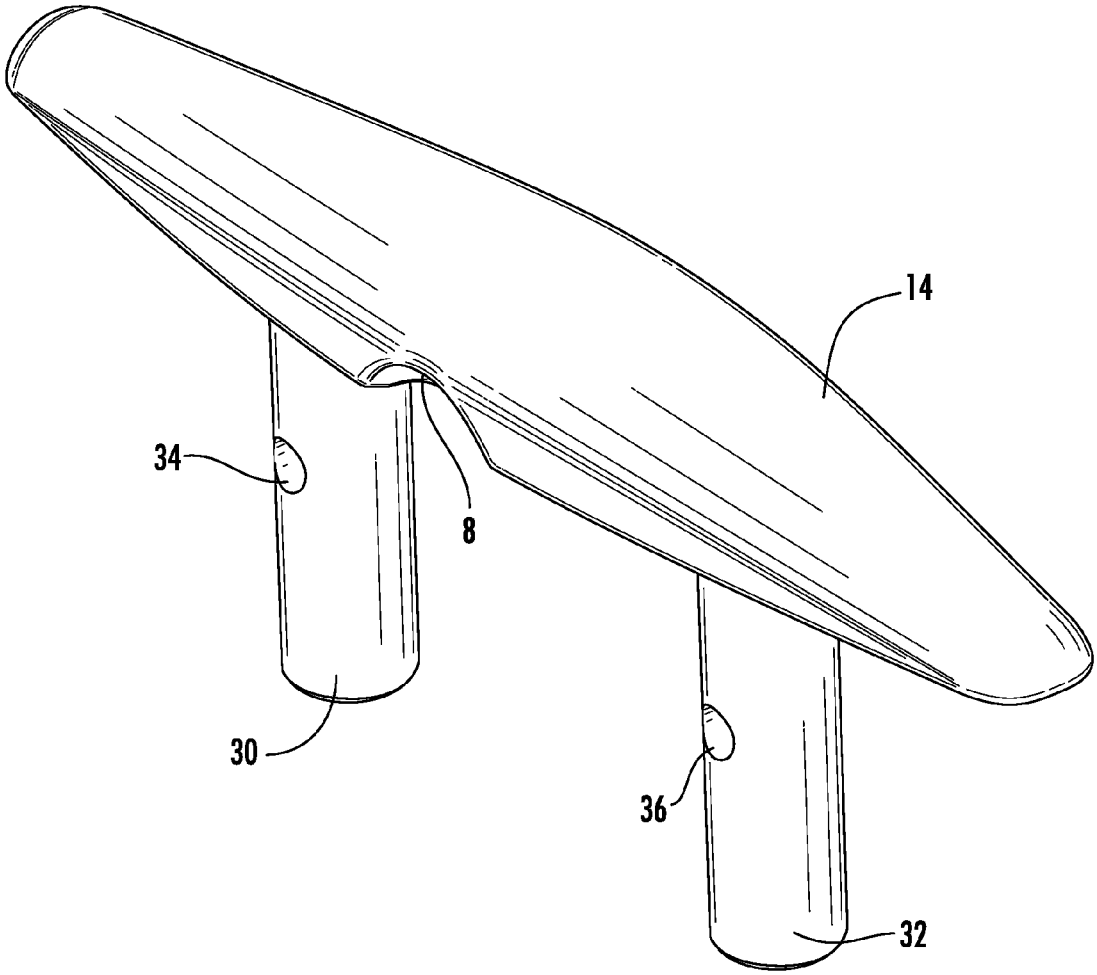
FIG. 1 illustrates a perspective view of the securing portion of the boat cleat.

Reference will now be made in detail to the presently preferred embodiments of the invention, examples of which are illustrated in the accompanying drawings. Throughout the following detailed description, the same reference numerals refer to the same elements in all figures.

A boat cleat assembly 10 shown in FIGS. 1-4 includes a base or housing member 12 and a securing portion 14. In use, when extended, a rope or line is tied to the securing portion 14 of the boat cleat 10. The securing member 14 has a surface and two legs 30/32 depending from one side of the surface.

The securing portion 14 of the boat cleat 10 has a raised position in which the securing portion 14 extends above the base 12. Likewise, the securing portion 14 has a retracted position in which the securing portion 14 is retracted against the base 12 and boat deck (not shown) for aesthetic, efficiency, and safety reasons (e.g. when in the retracted position, the boat cleat 10 looks nicer, exerts less air resistance, and is less likely to cause tripping).

The base 12 has a pair of receiving members 22/24 that are preferably, though not required to be, cylindrical. Being cylindrical facilitates installation in round holes as made by a standard drill. The base member also has a single threaded mounting bolt section 18. For installation, three holes are drilled/formed in the boat (e.g. deck), sized and spaced to accept the receiving members 22/24 and to accept the mounting bolt section 18. It is preferred that the inner diameter of the holes (not shown) are substantially the same size as the outer diameter of the corresponding receiving members 22/24 and mounting bolt section 18 to provide maximum structural strength and minimum opportunity for liquids (e.g., water) to pass through to the hull of the boat.

The receiving members 22/24 each have a vertically extending receiving opening 26/28 therein, for receiving the legs 30/32 of the securing portion 14. Each opening 26/28 is of a substantially similar cross-sectional shape as the opening's 26/28 corresponding leg 30/32. In one embodiment (as shown in the figures), the legs 30/32 are substantially cylindrical (circular cross section) as are the openings 26/28. The outer size (e.g. diameter) of the legs 30/32 is slightly less than the inner size (e.g. diameter) of the openings 26/28, thereby permitting axial movement of the legs 30/32 within the openings 26/28. Note that, to reduce liquid penetration, it is preferred, though not required, that the legs 30/32 are sized to fit snuggly within the openings 26/28. Although cylindrical legs 30/32 are shown, there is no limitation to the cross sectional shape of the legs 30/32 (and therefore the openings 26/28) and other shapes are equally anticipated such as oval cross sectional shapes.

The cross section of the legs 30/32 register with the cross section of the receiving member openings 26/28 and are received therein for relative axial movement.

Figure 4:
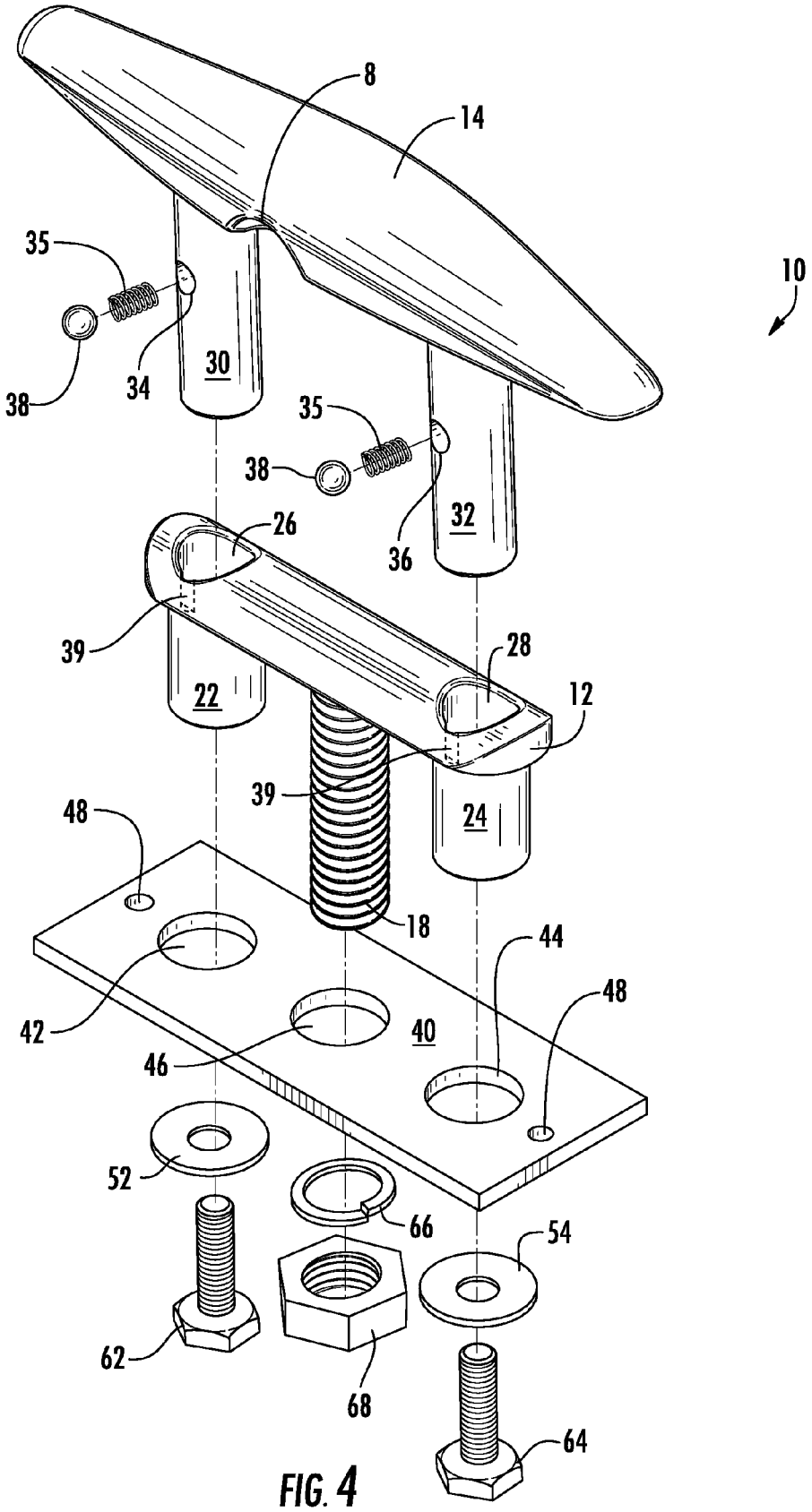
FIG. 4 illustrates an exploded view of the boat cleat, including the optional security plate of the boat cleat.

A detent mechanism 34/35/36/38/39 maintains the securing portion 14 in an extended position until force is applied to the securing portion 14. Once in the extended position, pushing downwardly on the securing portion 14 with sufficient force overcomes the detent mechanisms 34/35/36/38/39 and therefore, the legs 30/32 move axially into the receiving member openings 26/28. The detent mechanism 34/35/36/38/39 mechanically resists or arrests the securing portion 14 in the extended position until external force is applied to the securing portion to overcome the detent mechanism 34/35/36/38/39 and push the legs 30/32 into the receiving member openings 26/28. Although many detent mechanisms are anticipated, the example shown includes bores 34/36 formed in respective legs 30/32. During assembly, before inserting the legs 30/32 into the receiving member openings 26/28, a spring 35 and then a ball 38 is placed into each bore 34/36 (as shown in FIG. 4). The springs 35 apply outward force on the balls 30 providing a small amount of resistance to axial movement of the legs 30/32 within the receiving member openings 26/28. As the securing portion 14 is moved towards the extended position, the balls 35 are pushed into receiving channels 39 that are cut/formed on an inside surface of the receiving member openings 26/28, substantially in line with the respective bores 34/36. This detent action provides resistance to hold the securing portion 14 from leaving the extended position, until external force is applied to the securing portion 14 (e.g. a person pushed down on the securing portion 14).

During assembly, the legs 30/32 are inserted into and register with the cross section of the receiving member openings 26/28 and the legs 30/32 are prevented from exiting the receiving member openings 26/28 by at least bolts 62/64 and optionally washers 52/54. The ends of the legs 30/32 have fastener receiving bores (not shown) that are, for example, threaded to receive the bolts 62/64. In such, it is preferred that the outer diameter of heads of the bolts 62/64 and/or the optional washers 52/54 are larger than the inner diameter of the receiving member openings 26/28 so that the legs 30/32 will not exit the receiving member openings 26/28 when the securing portion 14 is pulled into the extended position. It is also preferred, though not required, that the diameter of the bolts 62/64 and/or the diameter of the washers 52/54 are less than or equal to the outer diameter of the receiving members 22/24 so that the bolts 62/64 and/or the washers 52/54 pass freely through the holes formed/drilled in an installation surface (e.g. a deck of a boat).

The mounting bolt portion 18 is threaded. After inserting the receiving members 22/24 and the mounting bolt portion 18 through the holes formed/drilled in the target surface (e.g. a boat surface), a nut 68 and optional lock washer 66 is threaded and tightened onto the mounting bolt portion 18, thereby holding the boat cleat 10 securely on the boat surface. The three appendages (receiving members 22/24 and mounting bolt portion 18) keep the boat cleat 10 from skewing or twisting.

In some installations, where additional strength is desired, a support plate 40 is installed under the boat surface. The support plate has holes 42/44/46 that are sized and positioned such that the receiving members 22/24 and mounting bolt portion 18 pass through the target surface and then through the support plate holes 42/44/46 and then the nut 68 and optional lock washer 66 are secured and tightened against the support plate 40. In some embodiments, additional holes 48 are made in the plate 40 for securing the plate 40 to the target surface.

Figure 2:
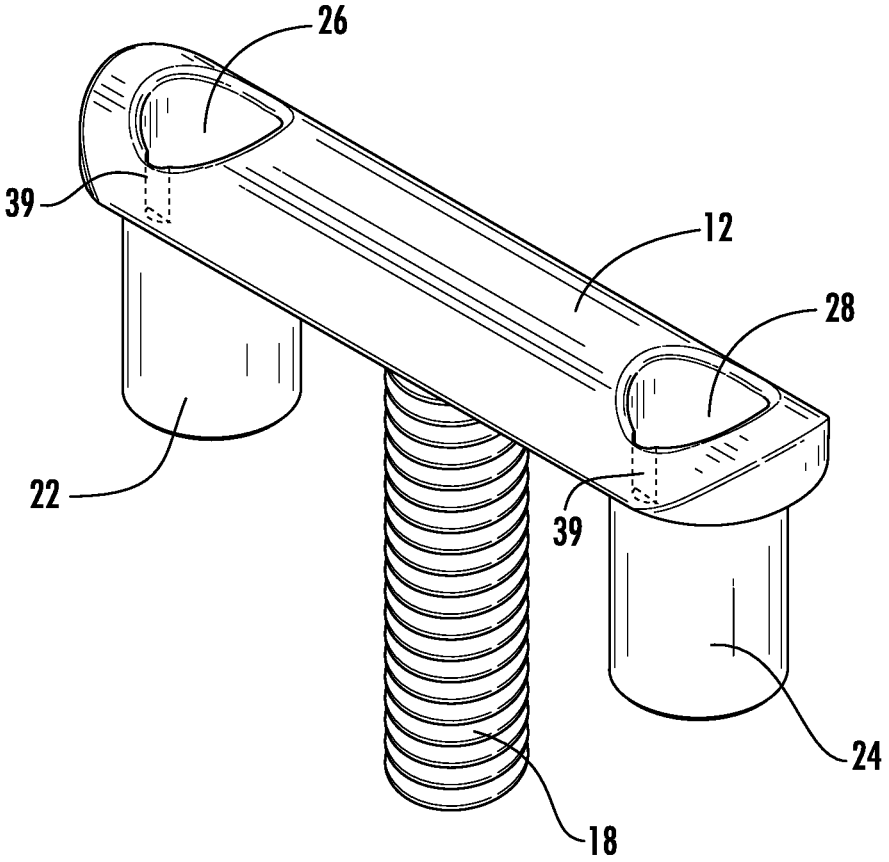
FIG. 2 illustrates a perspective view of the stationary portion of the boat cleat.
Figure 3:
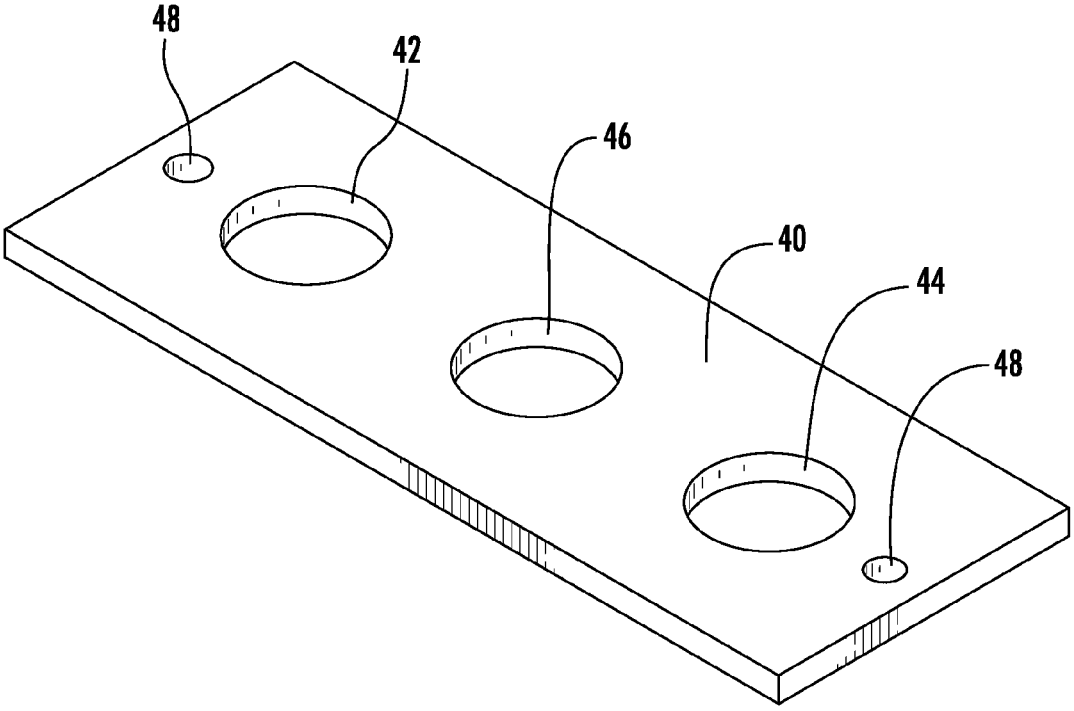
FIG. 3 illustrates a perspective view of an optional security plate of the boat cleat.

In a preferred embodiment, the exposed surface of the base 12 is curved or tapered as shown in FIG. 2, becoming thinner at the edges to reduce liquid build-up around the receiving openings 26/28. Also, in a preferred embodiment, the underside surface of the securing portion 14 is cupped to accommodate the volume and shape of the base 12, so that when the securing portion 14 is in the retracted position, the edges of the securing portion 14 touch the boat surface and the base 12 is contained beneath the cupped area and is not clearly visible. In this, the securing portion 14 covers the base 12 and receiving openings 26/28, further reducing seepage of liquids through any gaps between the legs 30/32 and the receiving openings 26/28.

To facilitate grasping of the securing portion 14 when moving the securing portion 14 from the retraced position to the extended position, it is preferred, though not required, that one or more finger tabs 8 are formed in the securing portion 14.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A cleat assembly comprising:

a securing member for accepting a line, the securing member having a surface and two legs depending from the surface, the legs are spaced apart;

a base member having two receiving members spaced to align with the legs, the legs extend into bores of the receiving members, the base member further comprising a single threaded bolt portion depending from the base member between the receiving members; and means to slideably retain the legs within the bores of the receiving members;

wherein an underside of the surface is cupped to accommodate a volume and a shape of the base such that, when the securing member is retracted, the securing member completely covers the base member.

2. The cleat assembly of claim 1, wherein means to slideably retain comprises a bolt threaded into each of the legs, a head of each bolt having a diameter greater than a diameter of a corresponding bore.

3. The cleat assembly of claim 1, wherein means to slideably retain comprises a bolt having a washer, the bolt threaded into each of the legs, each washer having a diameter greater than a diameter of a corresponding bore.

4. The cleat assembly of claim 1, further comprising a detent mechanism, the detent mechanism holding the securing member in a position extended from the base member until external force is applied to the securing member, pushing the securing member towards the base member.

5. The cleat assembly of claim 1, wherein an exposed surface of the base is curved in a convex shape to reduce liquid buildup and penetration into a gap between each of the legs and corresponding receiving member bores.

6. The cleat assembly of claim 1, further comprising a security plate, the security plate comprising three holes corresponding to each of the legs and the single threaded bolt portion.

7. The cleat assembly of claim 1, further comprising at least one finger tab on an edge of the surface of the securing member for facilitating grasping of the securing member when moving the securing member from a retracted position to an extended position.

8. A method of installing a boat cleat, the method comprising:

providing a boat cleat comprising:

a securing member for accepting a line, the securing member having a surface and two legs depending from the surface, the legs are spaced apart;

a base member having two receiving members spaced to align with the legs, the legs extend into bores of the receiving members, the base member further comprising a single threaded bolt portion depending from the base member between the receiving members; and means to slideably retain the legs within the bores of the receiving members;

creating exactly three holes in a surface, each hole aligning with one of the legs and the single threaded bolt portion;

feeding the legs and the single threaded bolt portion through the holes;

threading a nut onto the single threaded bolt portion; and tightening the nut, thereby securing the boat cleat to the surface.

9. The method of claim 8, further comprising before the step of threading, a step of installing a lock washer onto the single threaded bolt portion.

10. The method of claim 9, further comprising before the step of installing a lock washer, a step of installing a security plate, the security plate comprising three holes corresponding to each of the legs and the single threaded bolt portion.

11. The method of claim 8, wherein the boat cleat further comprises a detent mechanism, the detent mechanism holding the securing member in a position extended from the base member until external force is applied to the securing member, pushing the securing member towards the base member.

12. The method of claim 8, wherein an underside of the surface is cupped to accommodate a volume and a shape of the base such that, when the securing member is retracted, the securing member completely covers the base member.

13. A cleat assembly comprising:

a securing member for accepting a line, the securing member having a surface and two legs depending from the surface, the legs are spaced apart;

a base member having two receiving members spaced to align with the legs, the legs extend into bores of the receiving members, the base member further comprises a single threaded bolt portion depending from the base member between the receiving members; and a detent mechanism formed between the legs and the bores such that, when the securing member is in an extended position, the detent mechanism holds the securing member in the extended position until an overcoming force is applied on the securing member in a direction of the base member;

whereas the legs are slideably held within the bores of the receiving members by corresponding fasteners and washers;

wherein an exposed surface of the base is curved in a convex shape to reduce liquid buildup and penetration into a gap between each of the legs and corresponding receiving member bores.

14. The cleat assembly of claim 13, wherein each bore is cylindrical, each receiving member is cylindrical, each leg is cylindrical and each washer is round.

15. The cleat assembly of claim 13, wherein an outer diameter of each washer is greater than a diameter of a corresponding bore and is less than an outer diameter of a corresponding receiving member.

16. The cleat assembly of claim 13, wherein an underside of the surface is cupped to accommodate a volume and a shape of the base such that, when the securing member is retracted, the securing member completely covers the base member.

17. The cleat assembly of claim 13, further comprising a security plate, the security plate comprising three holes corresponding to each of the legs and the single threaded bolt portion.

18. The cleat assembly of claim 13, further comprising at least one finger tab on an edge of the surface of the securing member for facilitating grasping of the securing member when moving the securing member from a retracted position to an extended position.

* * * * *